United States Patent [19]

Boelens et al.

[11] 4,147,671

[45] Apr. 3, 1979

[54] PERFUME COMPOSITIONS CONTAINING 8 ALLYL-8-HYDROXYTRICYCLO [5,2,1,0$^{2,6}$] DECANE ALONE OR COMBINED WITH o-HYDROXYBENZYL ETHYL ETHER

[75] Inventors: Harmannus Boelens, Huizen; Hendrik J. Wobben, Naarden, both of Netherlands

[73] Assignee: Naarden International, N.V., Naarden-Bussum, Netherlands

[21] Appl. No.: 893,449

[22] Filed: Apr. 4, 1978

Related U.S. Application Data

[62] Division of Ser. No. 826,768, Aug. 22, 1977, Pat. No. 4,124,771, which is a division of Ser. No. 635,213, Nov. 25, 1975, Pat. No. 4,057,516.

[51] Int. Cl.$^2$ ..... C11B 9/00

[52] U.S. Cl. ..... 252/522

[58] Field of Search ..... 252/522

[56] References Cited

U.S. PATENT DOCUMENTS 3,417,132 12/1968 Dunkel ..... 260/488

3,557,188 1/1971 Dunkel ..... 260/468 G

FOREIGN PATENT DOCUMENTS 6605068 10/1966 Netherlands.

OTHER PUBLICATIONS

R. Chromocek, Chem. Listg. 49, pp. 1831, 1955.

J. de Jonge et al. Rec. Trav. Chim. 74, pp. 1448, 1955.

J. thiele et al., Ann 305 pp. 110, 1899.

*Primary Examiner*—Veronica O'Keefe

*Attorney, Agent, or Firm*—Stevens, Davis, Miller & Mosher

[57] ABSTRACT

Perfume compositions, perfumed materials and articles and a process for preparing perfume compositions, perfumed materials and articles which includes the steps of adding perfume components usual for this purpose and additionally at least one compound reminiscent of castoreum which is selected from o-hydroxybenzyl ethyl ether, 8-allyl-8-hydroxytricyclo (5,2.1.0$^{2,6}$) decane and mixtures thereof. Reminiscent of castoreum is 8-allyl-8-hydroxytricyclo (5,2,1,0$^{2,6}$) decane.

4 Claims, No Drawings

PERFUME COMPOSITIONS CONTAINING 8 ALLYL-8-HYDROXYTRICYCLO [5,2,1,0$^{2,6}$] DECANE ALONE OR COMBINED WITH O-HYDROXYBENZYL ETHYL ETHER

This is a Division of application Ser. No. 826,768 filed Aug. 22, 1977 now U.S. Pat. No. 4,124,771 which in turn is a division of application Ser. No. 635,213 filed Nov. 25, 1975, now U.S. 4,057,516.

This invention relates to a process for the preparation of a starting material to be used in perfumery. More specifically the invention relates to a process for imparting an improved odor of castoreum to perfume compositions and perfumed materials.

In perfumery many natural materials are used. However, these materials suffer from the disadvantage of not always being available in sufficient quantities. Moreover they are often expensive and not of consistent quality. The use of certain animal materials also may be objected to because of the danger of extinction of the animal species under consideration, or because collection of the product is annoying to the animal. So it is advantageous to prepare or compound synthetic perfume materials whose odor properties approach those of the natural materials as closely as possible. Castoreum is an animal material derived from beavers (Castor fiber). It is very popular for use in perfumery but is expensive and hard to obtain for the reasons set forth above.

In all attempts to imitate the odor of castoreum, compounds were used that are known to be constituents of natural castoreum (see for example: E. Lederer, Odeurs et Parfums des Animaux in "Fortschritte der Chemie organischer Naturstoffe" VI (1949), p. 112). However, an additional amount of natural castoreum was always necessary to obtain a high quality castoreum odor in perfume compositions (see for example: F. Cole, "Le Livre du Parfumeur", Casterman, Paris (1951), p. 421).

It was found that a very natural and satisfactory castoreum odor can be imparted to perfume compositions, without using any natural castoreum, by adding o-hydroxybenzyl ethyl ether of the formula

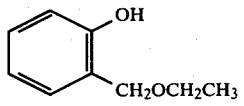

and/or 8-allyl-8-hydroxytricyclo [5,2,1,0$^{2,6}$] decane of the formula

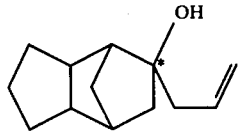

to other components commonly used in preparing perfume compositions.

The phrase "perfume composition" is used to mean a mixture consisting of for example essential oils, hydrocarbons, alcohols, esters, acids, aldehydes, ketones and other odorous and non-odorous substances. This mixture may be used as such, or after dilution with a suitable solvent (e.g. alcohol) to impart a desired odor to products like detergents, soaps, creams, lotions and other cosmetics.

O-hydroxybenzyl ethyl ether is known but the odor description given in the literature does not give any indication about its usefulness in perfumery. The preparation of o-hydroxybenzyl ethyl ether is described in: R. Chromecek, Chem. Listy 49 (1955), 1831; J. de Jonge and B.H. Bibo, Rec. Trav. Chim. 74 (1955), 1448; J. Thiele and O. Dimroth, Ann. 305 (1899), 110.

The compound 8-allyl-8-hydroxytricyclo [5,2,1,0$^{2,6}$]decane is prepared in a way known per se, from tricyclo [5,2,1,0$^{2,6}$]decane-8-one and an allylmagnesium halogenide. Both stereo-isomeric ketones (endo and exo) will undergo this Grignard reaction and both will yield two new stereo-isomers because of the introduction of a new asymmetric center (indicated by *). It is possible to separate the four stereo-isomers by methods known per se, but this is not necessary for practicing the invention. So for economical reasons the use of the mixture of isomers is preferred.

Although the odors of o-hydroxybenzyl ethyl ether and 8-allyl-8-hydroxytricyclo [5,2,1,0$^{2,6}$] decane are very different, they are both clearly reminiscent of castoreum. The compounds may be used either separately or together in preparing a synthetic castoreum, if desired in conjunction with compounds known to be components of natural castoreum (e.g. benzoic acid, salicyclic acid, their methyl and ethyl esters, cresol and other phenolic compounds, acetophenone, etc.). The addition of o-hydroxybenzyl ethyl ether accentuates the phenolic character and improves the odor of a synthetic castoreum when used in an amount of 1000 ppm by weight or more. On the other hand 8-allyl-8-hydroxytricyclo [5,2,1,0$^{2,6}$] decane has a more sweet animal character and improves the odor of a synthetic castoreum when used in amounts of 100 ppm by weight or more. Especially the combination of o-hydroxybenzyl ethyl ether and 8-allyl-8-hydroxytricyclo[5,2,1,0$^{2,6}$] decane makes it possible to obtain a very near approach to the odor of natural castoreum. With this combination a synthetic castoreum may be prepared which is so close to nature that it is able to substitute natural castoreum in any desired application. It is also possible to use o-hydroxybenzyl ethyl ether and 8-allyl-8-hydroxytricyclo[5,2,1,0$^{2,6}$] decane either separately or in combination, directly in a perfume composition to impart a castoreum effect.

The weight ratio of o-hydroxybenzyl ethyl ether to 8-allyl-8-hydroxytricyclo [5,2,1,0$^{2,6}$] decane to be used depends on the desired effect. In general it will be between 300:1 and 1:5. Preferably a ratio between 30:1 and 1:1 is used. As far as the use in synthetic castoreum is concerned, one has to keep in mind the minimum effective amounts of both compounds as described above. When using such a synthetic castoreum in a perfume composition, the concentrations of o-hydroxybenzyl ethyl ether and 8-allyl-8-hydroxytricyclo [5,2,1,0$^{2,6}$] decane in the final composition may be much lower, depending on the amount of synthetic castoreum used in this composition.

The following examples are illustrative for the preparation of 8-allyl-8-hydroxytricyclo [5,2,1,0$^{2,6}$] decane and the use of o-hydroxybenzyl ethyl ether and 8-allyl-8-hydroxytricyclo[5,2,1,0$^{2,6}$] decane as perfume components.

Example 1

Preparation of 8-allyl-8-hydroxytricyclo [5,2,1,$0^{2,6}$] decane.

In a one litre reaction vessel, equipped with a stirrer, a cooler and a dropping funnel, 26.4 g magnesium, 100 g tetrahydrofurane and 1 g allyl chloride were heated to about 40° C. to start the reaction. A mixture of 76.5 g allyl chloride, 250 g tetrahydrofurane and 150 g tricyclo [5,2,1,$0^{2,6}$] decan-8-one was added in four hours, keeping the temperature at 35°–40° C. The reaction mixture was stirred for an additional 30 minutes and subsequently poured into a mixture of 600 g of ice and 80 g of acetic acid. The layers were separated and the water layer extracted twice with toluene. The combined organic layers were washed with 5% soda solution until alkaline and subsequently with water until neutral. The organic solvent was removed by distillation under reduced pressure. The residue was distilled on a Vigreux head at 2 mm.Hg. The fraction boiling between 93° and 95° C. was collected.

Yield: 80%, $n_D^{20}$: 1.5154.

EXAMPLE 2

A synthetic castoreum was prepared by mixing the following ingredients (amounts given in parts by weight):

| | |
|---|---|
| 738 | benzoic acid |
| 50 | farnesol |
| 20 | farnesyl acetate |
| 10 | farnesyl isobutyrate |
| 15 | o-cresol |
| 5 | p-cresol |
| 4 | m-cresol |
| 6 | salicylic acid |
| 2 | borneol |
| 1 | eugenylphenyl acetate |
| 25 | ethyl benzoate |
| 10 | methyl benzoate |
| 6 | methyl phenyl carbinol |
| 4 | acetophenone |
| 2 | pentanoic acid |
| 2 | butanoic acid |
| 900 | This mixture was called mixture A. |

The following mixtures were prepared:

| | | |
|---|---|---|
| Mixture B: | 900 | parts by weight of mixture A |
| | 85 | parts by weight of o-hydroxybenzyl ethyl ether |
| | 985 | parts. |
| Mixture C: | 900 | parts by weight of mixture A |
| | 15 | parts by weight of 8-allyl-8-hydroxytricyclo-[5,2,1,$0^{2,6}$] decane |
| | 915 | parts. |
| Mixture D: | 900 | parts by weight of mixture A. |
| | 85 | parts by weight of o-hydroxybenzyl ethyl ether |
| | 15 | parts by weight of 8-allyl-8-hydroxitricyclo-[5,2,1,$0^{2,6}$] decane |
| | 1000 | parts. |

The mixtures A, B, C and D were compared by 7 trained perfumers. B and C were unanimously preferred over A. Two experts preferred C over B, the others preferred B over C. However D was judged unanimously as the mixture with the best and most natural castoreum odor.

EXAMPLE 3

By mixing the following ingredients a men's cologne concentrate was prepared using the synthetic castoreum mixture D of Example 2 (amounts given in parts by weight):

| | |
|---|---|
| 15 | musk-ketone |
| 15 | Musk R1® (11-oxa-hexadecanolide) |
| 10 | tonka absolute |
| 10 | heliotropine |
| 20 | benzylisoeugenol |
| 15 | mousse absolute |
| 10 | galbarum resin |
| 15 | benzoe resin Siam |
| 75 | lemon oil Italian |
| 200 | bergemot oil |
| 10 | verveic oil |
| 100 | sandalwood oil E.I. |
| 100 | α-idomethylionone |
| 50 | cedarwood oil Virginia |
| 25 | clove bud oil |
| 50 | Rosana NB 131* |
| 50 | Jasmin NB 133* |
| 50 | vetiveryl acetate |
| 25 | yland ylang I |
| 10 | geranium oil Bourbon |
| 10 | basil oil |
| 10 | angelica root oil |
| 10 | clary sage oil |
| 50 | lavender oil 45–47% |
| 30 | lauric aldehyde, 10% in diethyl phthalate |
| 10 | civette absolute, 10% in ethanol |
| 25 | mixture D of Example 2, 10% in benzylalcohol. |
| 1000 | |

®registered trade mark of Naarden International
*perfume base of Naarden International.

What is claimed is:

1. A perfume composition comprising components usual for this purpose and at least one compound reminiscent of castoreum selected from the group consisting of 8-allyl-8-hydroxytricyclo 5,2,1,$0^{2,6}$ decane or a mixture of 8-allyl-8-hydroxytricyclo-5,2,1,$0^{2,6}$ decane and o-hydroxybenzyl ethyl ether.

2. A perfume composition comprising perfume components usual for this purpose and at least one compound reminiscent of castoreum selected from the group consisting of 8-allyl-8-hydroxytricyclo-[5,2,1,$0^{2,6}$] decane in a quantity of at least 100 ppm of the composition and mixtures of o-hydroxybenzyl ethyl ether and 8-allyl-8-hydroxytricyclo-[5,2,1,$0^{2,6}$] decane.

3. The perfume composition of claim 2, wherein the ratio between o-hydroxybenzyl ethyl ether and 8-allyl-8-hydroxytricyclo-[5,2,1,0,$^{2,6}$] decane lies between 300:1 and 1:5.

4. The perfume composition of claim 2 wherein the ratio between o-hydroxybenzyl ethyl ether and 8-allyl-8-hydroxytricyclo-[5,2,1,$0^{2,6}$] decane lies between 30:1 and 1:1.

* * * * *